US005122205A

United States Patent [19]

Masumoto et al.

[11] Patent Number: 5,122,205

[45] Date of Patent: Jun. 16, 1992

[54] CORROSION RESISTANT ALUMINUM-BASED ALLOY

[75] Inventors: Tsuyoshi Masumoto; Akihisa Inoue, both of Sendai; Junichi Nagahora, Yokohama; Katsumasa Ohtera, Kanagawa; Kazuo Aikawa, Namerikawa; Madoka Nakajima, Kobe; Keiko Yamagata, Tateyama, all of Japan

[73] Assignee: Yoshida Kogyo K.K., Tokyo, Japan

[21] Appl. No.: 513,242

[22] Filed: Apr. 23, 1990

[30] Foreign Application Priority Data

Apr. 25, 1989 [JP] Japan ..... 1-103355
Mar. 5, 1990 [JP] Japan ..... 2-51823

[51] Int. Cl.[5] ..... C22C 21/00
[52] U.S. Cl. ..... 148/403; 420/551
[58] Field of Search ..... 148/403, 421; 420/551, 420/583, 588, 422

[56] References Cited

U.S. PATENT DOCUMENTS 4,891,068 1/1990 Masumoto et al. ..... 148/403
5,053,084 10/1991 Masumoto et al. ..... 148/403

FOREIGN PATENT DOCUMENTS 0136508 4/1985 European Pat. Off. .
0303100 2/1989 European Pat. Off. .

*Primary Examiner*—Prince Willis, Jr.
*Assistant Examiner*—Jerry D. Johnson
*Attorney, Agent, or Firm*—Flynn, Thiel, Boutell & Tanis

[57] ABSTRACT

The present invention provides a corrosion resistant aluminum-based alloy consisting of a compound which has a composition represented by the general formula:

$$Al_aM_bMo_cHf_dCr_e$$

wherein:

M is at least one metal element selected from Ni, Fe and Co and a, b, c, d and e are atomic percentages falling within the following ranges: $50\% \leqq a \leqq 88\%$, $2\% \leqq b \leqq 25\%$, $2\% \leqq c \leqq 15\%$, $4\% \leqq d \leqq 20\%$ and $4\% \leqq e \leqq 20\%$, the compound being at least 50% by volume composed of an amorphous phase. The aluminum-based alloys not only have a high degree of hardness, strength and heat resistance but also exhibit a significantly improved corrosion resistance.

15 Claims, 2 Drawing Sheets

CORROSION RESISTANT ALUMINUM-BASED ALLOY

BACKGROUND OF THE INVENTION

1. Field of the Invention

The present invention relates to aluminum-based alloys having a superior corrosion resistance together with a high degree of strength, heat-resistance and wear-resistance, which are useful in various industrial applications.

2. Description of the prior art

As conventional aluminum-based structural material, there have been known pure aluminum and aluminum-based alloys, such as Al-Mg alloy, Al-Cu alloy, Al-Mn alloy or the like and the known aluminum-based materials have been used extensively in a variety of applications, for example, structural materials for components of aircrafts, cars, ships or the like; outer building materials, sashes, roofs, etc.; materials for components of marine apparatuses and nuclear reactors, etc., according to their properties.

In the conventional aluminum-based alloy materials, passive films which can protect the metallic material in mild environments, are easily broken in an aqueous solution of hydrochloric acid or sodium hydroxide or can not be safely used over a long time in an aqueous sodium chloride solution (e.g., sea water). Particularly, because of severe corrosiveness of an aqueous solution of hydrochloric acid or sodium hydroxide, there are no metallic materials which can be safely used in such corrosive aqueous solutions. The known aluminum-based alloys as mentioned above are not exceptional and can not give satisfactory service in such applications. Therefore, there has been a strong demand for new aluminum-based alloys which can provide a sufficiently long service life in such corrosive environments.

SUMMARY OF THE INVENTION

In view of the above, an object of the present invention is to provide novel aluminum-based alloys at a relatively low cost which exhibit a superior corrosion resistance in the foregoing corrosive environments together with an advantageous combination of properties of high hardness, high strength, good heat-resistance and good wear-resistance.

In order to overcome the above disadvantages, the present invention provides an aluminum alloy, which is hardly produced by conventional casting processes including a melting step, as an amorphous alloy with advantageous characteristics such as high corrosion-resistance and high wear-resistance, but not as a heterogeneous crystalline alloy.

According to the present invention, there is provided a corrosion resistant aluminum-based alloy consisting of a compound which has a composition represented by the general formula:

$$Al_aM_bMo_cHf_dCr_e$$

wherein:

M is one or more metal elements selected from Ni, Fe and Co, and a, b, c, d and e are atomic percentages falling within the following ranges: $50\% \leqq a \leqq 88\%$, $2\% \leqq b \leqq 25\%$, $2\% \leqq c \leqq 15\%$, $4\% \leqq d \leqq 20\%$ and $4\% \leqq e \leqq 20\%$, the compound being at least 50% by volume composed of an amorphous phase.

DETAILED DESCRIPTION OF THE PREFERRED EMBODIMENTS

Figure 1:
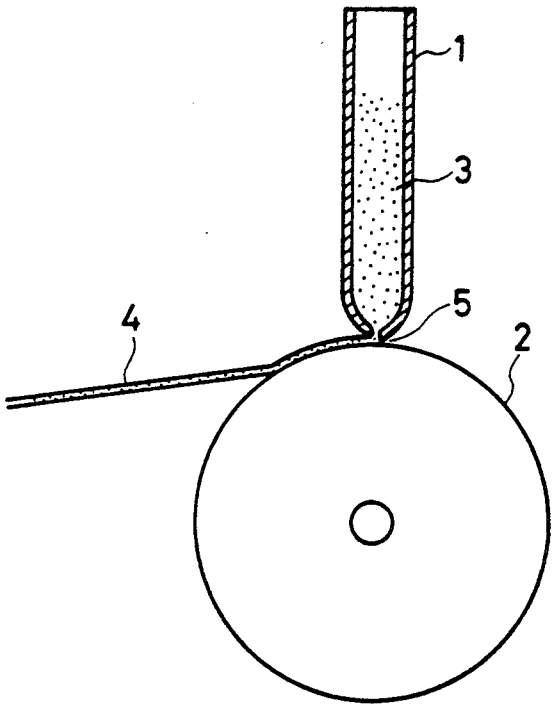
FIG. 1 shows an illustration showing an embodiment of a production process according to the present invention.

Generally, an alloy has a crystalline structure in the solid state. However, in the preparation of an alloy with a certain composition, an amorphous structure, which is similar to liquid but does not have a crystalline structure, is formed by preventing the formation of long-range order structure during solidification through, for example, rapid solidification from the liquid state. The thus obtained alloy is called an amorphous alloy. Amorphous alloys are generally composed of a homogeneous single phase of supersaturated solid solution and have a significantly higher strength as compared with ordinary practical metallic materials. Further, amorphous alloys may exhibit a very high corrosion resistance and other superior properties depending on their compositions.

The aluminum-based alloys of the present invention can be produced by rapidly solidifying a melt of an alloy having the composition as specified above employing liquid quenching methods. Liquid quenching methods are known as methods for the rapid solidification of alloy melts and, for example, the single roller melt-spinning method, the twin-roller melt-spinning method and the in-rotating-water melt-spinning method are especially effective. In these methods, a cooling rate of about $10^4$ to $10^7$ K/sec can be obtained. In order to produce thin ribbon materials by the single-roller melt-spinning method, twin-roller melt-spinning method or the like, a molten alloy is ejected from the opening of a nozzle to a roll of, for example, copper or steel, with a diameter of about 30–300 mm which is rotating at a constant rate of about 300–10000 rpm. In these methods, various thin ribbon materials with a width of about 1–300 mm and a thickness of about 5–500 μm can be readily obtained. Alternatively, in order to produce wire materials by the in-rotating-water melt-spinning method, a jet of a molten alloy is directed, under application of a back pressure of argon gas, through a nozzle into a liquid refrigerant layer with a depth of about 1 to 10 cm which is held by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the relative velocity of the ejecting molten alloy to the liquid refrigerant surface is preferably in the range of about 0.7 to 0.9.

Further, the aluminum-based alloys of the present invention may be also obtained by depositing a source material having the composition represented by the above general formula onto a substrate employing thin film formation techniques, such as sputtering, vacuum deposition, ion plating, etc. and thereby forming a thin film having the above composition.

As the sputtering deposition process, there may be mentioned diode sputtering process, triode sputtering process, tetrode sputtering process, magnetron sputtering process, opposing target sputtering process, ion beam sputtering process, dual ion beam sputtering process, etc. and, in the former five processes, there are a direct current application type and a high-frequency application type.

The sputtering deposition process will be more specifically described hereinafter. In the sputtering deposition process, a target having the same composition as that of the thin film to be formed is bombarded by ion sources produced in the ion gun or the plasma, etc., so that neutral particles or ion particles in the state of atoms, molecules or clusters are produced from the target by its bombardment. The neutral or ion particles produced in a such manner are deposited onto the substrate and the thin film as defined above is formed.

Particularly, ion beam sputtering, plasma sputtering, etc., are effective and these sputtering processes provide a cooling rate of the order of $10^5$ to $10^7$ K/sec. Due to such a cooling rate, it is possible to produce an alloy thin film having at least 50 volume % composed of an amorphous phase. The thickness of the thin film can be adjusted by the sputtering time and, usually, the thin film formation rate is on the order of 2 to 7 $\mu$m per hour.

A further embodiment of the present invention in which magnetron plasma sputtering is employed is specifically described. In a sputtering chamber in which the sputtering gas is held at a low pressure ranging from $1\times10^{-3}$ to $10\times10^{-3}$ mbar, an electrode (anode) and a target (cathode) composed of the composition defined above are disposed opposite to one another at a spacing of 40 to 80 mm and a voltage of 200 to 500 V is applied to form a plasma between the electrodes. A substrate on which the thin film is to be deposited is disposed in this plasma forming area or in the vicinity of the area and the thin film is formed.

Besides the above processes, the alloy of the present invention can be also obtained as rapidly solidified powder by various atomizing processes, for example, a high pressure gas atomizing process, or a spray process.

Whether the rapidly solidified aluminum-base alloys thus obtained are amorphous or not can be determined by an ordinary X-ray diffraction method because an amorphous structure provides characteristic halo patterns.

In the aluminum-based alloys of the present invention having the general formula as defined above, the reason why a, b, c, d and e are limited as set forth above by the atomic percentages is that when they fall outside the respective ranges, the formation of the amorphous structure becomes difficult or the resulting alloys are brittle, thereby presenting difficulties in bending operations. Further, when a, b, c, d and e are not within the specified ranges, the intended compounds having at least 50% by volume of an amorphous phase can not be obtained by industrial processes such as sputtering deposition.

Element M, which is at least one metal element selected from the group consisting Ni, Fe, and Co, Mo element and Hf element, have the effect of improving the ability to produce an amorphous structure and, at the same time, improve the hardness, strength and heat resistance. Particularly, Hf element is effective to improve the ability to form an amorphous phase.

Cr, as an important component, greatly improves the corrosion resistance of the invention alloy because Cr forms a passive film in cooperation with Mo and Hf when it is coexistent with them in the alloy. The reason why the atomic percentage (e) of Cr is limited to the aforesaid range is that amounts of Cr of less than 4 atomic % can not improve sufficiently the corrosion resistance contemplated by the present invention, while amounts exceeding 20 atomic % make the resultant alloy brittle and impractical for industrial applications.

Further, when the aluminum-based alloy of the present invention is prepared as a thin film, it has a high degree of toughness depending upon its composition. Therefore, such a tough alloy can be subjected to a bending of 180° without cracking or peeling from a substrate.

Now, the present invention will described with reference to the following examples.

EXAMPLE 1

Molten alloy 3 having a predetermined composition was prepared using a high-frequency melting furnace and charged into a quartz tube 1 having a small opening 5 (diameter: 0.5 mm) at the tip thereof, as shown in FIG. 1. After heating to melt the alloy 3, the quartz tube 1 was disposed right above a copper roll 2. Then, the molten alloy 3 contained in the quartz tube 1 was ejected from the small opening 5 of the quartz tube 1 under the application of an argon gas pressure of 0.7 kg/cm$^2$ and brought into contact with the surface of the roll 2 rapidly rotating at a rate of 5,000 rpm. The molten alloy 3 was rapidly solidified and an alloy thin ribbon 4 was obtained.

Alloy thin ribbons prepared under the processing conditions as described above were each subjected to X-ray diffraction analysis. It was confirmed that an amorphous phase was formed in the resulting thin ribbons. The composition of each thin ribbon was determined by a quantitative analysis using an X-ray microanalyzer.

Test specimens having a predetermined length were cut from the aluminum-based alloy thin ribbons and tested for corrosion resistance against HCl in a 1N-HCl aqueous solution at 30° C. Further test specimens having a predetermined length were cut from the aluminum-based alloy thin ribbons and tested for corrosion resistance to sodium hydroxide in a 1N-NaOH aqueous solution at 30° C. The test results are given in Table 1. In the table, corrosion resistance was evaluated in terms of corrosion rate. For comparison, commercially available 4N-Al (99.99% Al) and Al-Cu alloy (duralmin) were subjected to the same corrosion resistance tests. It is clear from Table 1 that the aluminum-based alloys of the present invention show a superior corrosion resistance in an aqueous hydrochloric acid solution and an aqueous sodium hydroxide solution as compared with the commercial aluminum-based alloys.

TABLE 1

| Corrosion rates measured in an aqueous 1N—HCl solution and an aqueous 1N—NaOH solution at 30° C. | | | |
|---|---|---|---|
| Alloy (at %) | 1N—HCl 30° C. corrosion rate (mm/year) | 1N—NaOH 30° C. corrosion rate (mm/year) | Structure* |
| $Al_{74.8}Ni_{6.5}Mo_{4.7}Hf_{7.5}Cr_{6.5}$ | $1.9 \times 10^{-1}$ | $1.7 \times 10^{-1}$ | Amo |
| $Al_{70.0}Fe_{9.4}Mo_{4.7}Hf_{9.4}Cr_{6.5}$ | $2.3 \times 10^{-1}$ | $2.7 \times 10^{-1}$ | Amo |
| $Al_{57}Ni_8Mo_8Hf_{12}Cr_{15}$ | $2.0 \times 10^{-2}$ | $5.0 \times 10^{-3}$ | Amo |
| $Al_{60}Ni_{24}Mo_4Hf_4Cr_8$ | $2.5 \times 10^{-1}$ | $4.0 \times 10^{-3}$ | Amo + Cry |
| $Al_{69}Ni_6Mo_7Hf_9Cr_9$ | $6.0 \times 10^{-2}$ | $4.0 \times 10^{-3}$ | Amo |
| $Al_{71}Co_6Mo_7Hf_7Cr_9$ | $1.2 \times 10^{-1}$ | $2.5 \times 10^{-2}$ | Amo |
| $Al_{75}Ni_7Mo_3Hf_8Cr_7$ | $2.4 \times 10^{-1}$ | $7.1 \times 10^{-2}$ | Amo |
| $Al_{73}Ni_6Mo_5Hf_7Cr_9$ | $2.5 \times 10^{-1}$ | $1.3 \times 10^{-2}$ | Amo + Cry |
| $Al_{67}Ni_6Fe_9Mo_4Hf_7Cr_7$ | $1.3 \times 10^{-1}$ | $1.0 \times 10^{-2}$ | Amo |
| 4N—Al(99.99% Al) | $8.2 \times 10^{-1}$ | $1.26 \times 10^{2}$ | — |
| Al—Cu alloy (duralmin) | $1.3 \times 10$ | $1.70 \times 10^{2}$ | — |

Remark:
Amo: Amorphous structure
Cry: Crystalline structure

Figure 2:
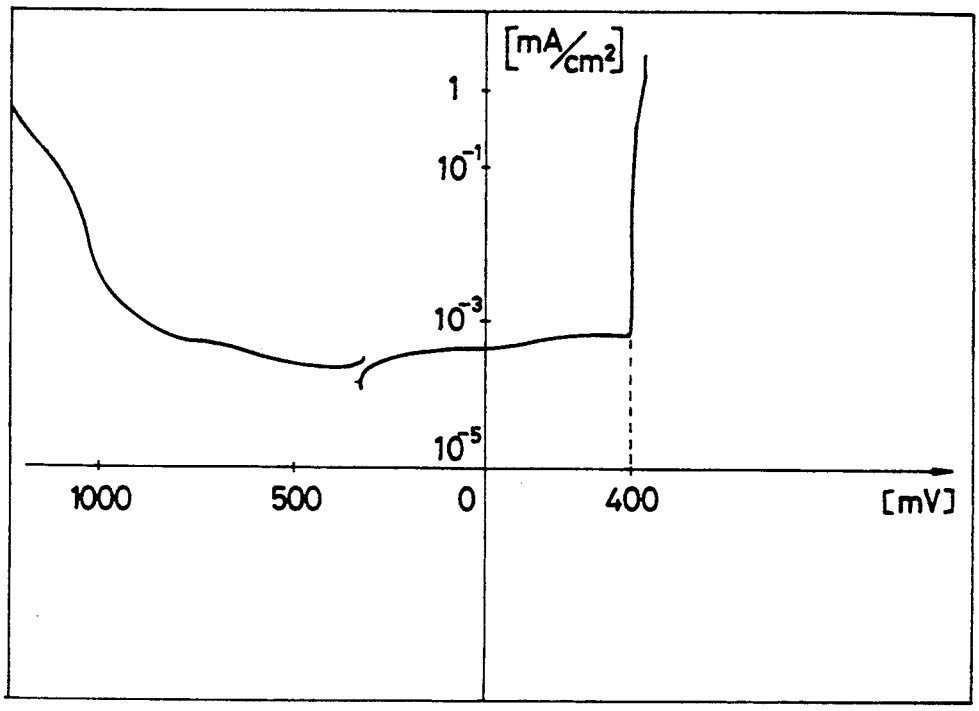
FIG. 2 is a polarization curve which was obtained by immersing an alloy of the present invention in a 1N-HCl aqueous solution at 30° C. for a period of 24 hours and then measuring the potential (mV) and current density ($mA/cm^2$) of the alloy in an aqueous solution containing 30 g/l of NaCl at 30° C.
Figure 3:
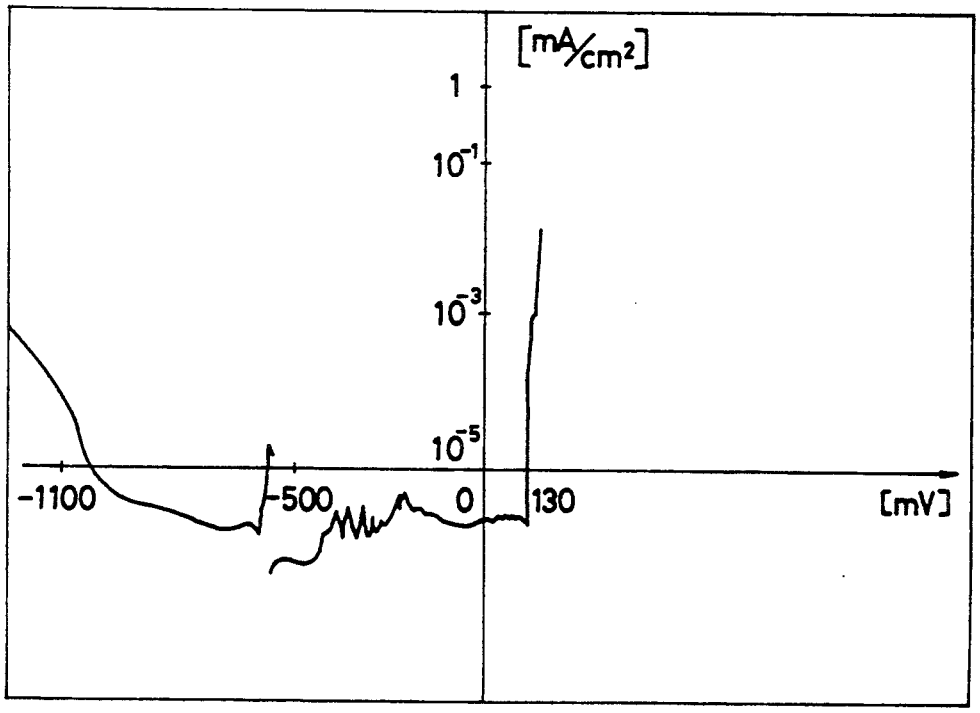
FIG. 3 is a polarization curve which was obtained by immersing another alloy of the present invention in a 1N-NaOH aqueous solution at 30° C. for a period of 8 hours and then measuring the potential (mV) and current density ($mA/cm^2$) of the alloy in an aqueous solution containing 30 g/l of NaCl at 30° C.

Further, the thin ribbons of $Al_{70.0}Fe_{9.4}Mo_{4.7}Hf_{9.4}Cr_{6.5}$ and $Al_{74.8}Ni_{6.5}Mo_{4.7}Hf_{7.5}Cr_{6.5}$ according to the present invention were tested in an aqueous solution containing 30 g/l of NaCl at 30° C. and the results of the evaluation in terms of pitting potential are shown in Table 2. Another sample of the $Al_{74.8}Ni_{6.5}Mo_{4.7}Hf_{7.5}Cr_{6.5}$ thin ribbon was immersed in an aqueous 1N-HCl solution for 24 hours. A further sample of the $Al_{74.8}Ni_{6.5}Mo_{4.7}Hf_{7.5}Cr_{6.5}$ thin ribbon was immersed in an aqueous 1N-NaOH solution for 8 hours. These two thin ribbons were each examined in an aqueous 30 g/l NaCl solution at 30° C. to obtain polarization curves and were evaluated for corrosion-resistance. The results were shown in Table 2, and FIGS. 2 and 3. In Table 2, corrosion resistance was evaluated in terms of pitting potential and the foregoing commercial alloy 4N-Al is also shown for comparison. As is clear from the results of the measurements given in Table 2, the Al-based alloys of the present invention are spontaneously passive in the aqueous solution containing 30 g/l of NaCl at 30° C. and formed a very highly passive film as compared with the commercial aluminum-based alloy. Further, when the alloys of the present invention were immersed in the aqueous hydrochloric acid solution or the aqueous sodium hydroxide solution, they were spontaneously passive and formed a higher passive film. Especially, the alloy $Al_{74.8}Ni_{6.5}Mo_{4.7}Hf_{7.5}Cr_{6.5}$ which was immersed for 24 hours in the aqueous solution of 1N-HCl and showed a pitting potential of 380 mV. This pitting potential level is well comparable to Cu (copper) which is recognized as an electrochemically noble metal. It is clear from the above test results that the aluminum-based alloys of the present invention have a considerably high corrosion-resistance.

TABLE 2

| Pitting potentials measured in an aqueous 30 g/l NaCl solution | | |
|---|---|---|
| Alloy (at. %) | Pitting potential mV (SCE) | Remark |
| $Al_{70.0}Fe_{9.4}Mo_{4.7}Hf_{9.4}Cr_{6.5}$ | 0 | |
| $Al_{74.8}Ni_{6.5}Mo_{4.7}Hf_{7.5}Cr_{6.5}$ | −150 | |
| $Al_{74.8}Ni_{6.5}Mo_{4.7}Hf_{7.5}Cr_{6.5}$ | +380 | * |
| $Al_{74.8}Ni_{6.5}Mo_{4.7}Hf_{7.5}Cr_{6.5}$ | +105 | ** |
| 4N—Al (99.99% Al) | −690 | |

Remark:
*Thin ribbon immersed in 1N—HCl at 30° C. for 24 hrs.
**Thin ribbon immersed in 1N—NaOH at 30° C. for 8 hrs.

EXAMPLE 2

The amorphous alloys of the present invention prepared by the production procedure set forth in Example 1 were ground or crushed to a powder form and used as pigments for metallic paints. As a result, the amorphous alloys had a high resistance to corrosion attack in the metallic paints over a long period of time and provided highly durable metallic paints.

As described above, since the Al-based alloys of the present invention have at least 50% by volume of an amorphous phase, they have an advantageous combination of properties of high hardness, high strength, high heat-resistance and high wear-resistance which are all characteristic of amorphous alloys. Further, the alloys form highly corrosion-resistant protective passive films which are durable for a long period of time in severe corrosive environments, such as hydrochloric acid solution or sodium chloride solution containing chlorine ions or sodium hydroxide solution containing hydroxyl ions and exhibit a very high corrosion-resistance.

What is claimed is:

1. A corrosion resistant aluminum-based alloy consisting of a compound which has a composition represented by the general formula:

$$Al_aM_bMo_cHf_dCr_e$$

wherein:

M is one or more metal elements selected from Ni, Fe and Co, and a, b, c, d and e are atomic percentages falling within the following ranges: $50\% \leqq a \leqq 88\%$, $2\% \leqq b \leqq 25\%$, $2\% \leqq c \leqq 15\%$, $4\% \leqq d \leqq 20\%$ and $6.5\% \leqq e \leqq 20\%$, the compound being at least 50% by volume composed of an amorphous phase.

2. The alloy of claim 1, wherein M is selected from the group consisting of Fe, Co and mixtures thereof.

3. The alloy of claim 1, wherein M is Fe.

4. The alloy of claim 1, wherein M is Co.

5. The alloy of claim 1, wherein said composition is $Al_{74.8}Ni_{6.5}Mo_{4.7}Hf_{7.5}Cr_{6.5}$.

6. The alloy of claim 1, wherein said composition is $Al_{70.0}Fe_{9.4}Mo_{4.7}Hf_{9.4}Cr_{6.5}$.

7. The alloy of claim 1, wherein said composition is $Al_{57}Ni_8Mo_8Hf_{12}Cr_{15}$.

8. The alloy of claim 1, wherein said composition is $Al_{60}Ni_{24}Mo_4Hf_4Cr_8$.

9. The alloy of claim 1, wherein said composition is $Al_{69}Ni_6Mo_7Hf_9Cr_9$.

10. The alloy of claim 1, wherein said composition is $Al_{71}Co_6Mo_7Hf_7Cr_9$.

11. The alloy of claim 1, wherein said composition is $Al_{75}Ni_7Mo_3Hf_8Cr_7$.

12. The alloy of claim 1, wherein said composition is $Al_{73}Ni_6Mo_5Hf_7Cr_9$.

13. The alloy of claim 1, wherein said composition is $Al_{67}Ni_6Fe_9Mo_4Hf_7Cr_7$.

14. The alloy of claim 1, wherein M is Ni and Co.

15. The alloy of claim 1, wherein M is Ni and Fe.

* * * * *